United States Patent [19]

Seko et al.

[11] 4,005,004

[45] Jan. 25, 1977

[54] ELECTRODE COATING CONSISTING OF A SOLID SOLUTION OF A NOBLE METAL OXIDE, TITANIUM OXIDE, AND ZIRCONIUM OXIDE

[75] Inventors: Maomi Seko, Tokyo; Shinsaku Ogawa, Nobeoka; Mitsuo Yoshida, Nobeoka; Akira Nakamura, Nobeoka, all of Japan

[73] Assignee: Asahi Kasei Kogyo Kabushiki Kaisha, Osaka, Japan

[22] Filed: Sept. 10, 1975

[21] Appl. No.: 611,889

[30] Foreign Application Priority Data

Sept. 27, 1974 Japan ..... 49-11105

[52] U.S. Cl. ..... 204/290 F; 204/290 R; 427/58; 427/126; 427/379; 427/380

[51] Int. Cl.[2] ..... C25B 11/10

[58] Field of Search ..... 204/290 F, 290 R; 427/126, 58, 379, 380

[56] References Cited

UNITED STATES PATENTS

| | | | |
|---|---|---|---|
| 3,632,498 | 1/1972 | Beer | 204/290 F |
| 3,677,917 | 7/1972 | Martinson | 204/290 F |
| 3,711,385 | 1/1973 | Beer | 427/126 |
| 3,773,554 | 11/1973 | Scrutton et al. | 427/126 |
| 3,773,555 | 11/1973 | Cotton et al. | 204/290 F |
| 3,778,307 | 12/1973 | Beer | 204/290 F |
| 3,852,175 | 12/1974 | Hoekje | 204/290 F |
| 3,869,312 | 3/1975 | Moss et al. | 204/290 F |

*Primary Examiner*—Mayer Weinblatt
*Assistant Examiner*—John D. Smith
*Attorney, Agent, or Firm*—Cooper, Dunham, Clark, Griffin & Moran

[57] ABSTRACT

A solid solution of a noble metal oxide, titanium oxide and zirconium oxide, containing 1 to 50 mol % of titanium oxide and zirconium oxide as the total content, is coated on an anti-corrosive substrate, e.g. titanium metal to give an electrode which is excellent in low oxygen content in chlorine gas, low electrode consumption and low chlorine overvoltage when it is used as anode for electrolysis of an aqueous sodium chloride solution.

16 Claims, No Drawings

ELECTRODE COATING CONSISTING OF A SOLID SOLUTION OF A NOBLE METAL OXIDE, TITANIUM OXIDE, AND ZIRCONIUM OXIDE

This invention relates to an improved electrode which can be used for electrolysis of an aqueous alkali metal halide (e.g. sodium chloride) solution and a process for producing the same. More particularly, this invention relates to an electrode comprising an anticorrosive conductor which is coated with a solid solution at least three components of a noble metal oxide and 1 to 50 mol % of titanium oxide and zirconium oxide and to a process for producing the same.

Heretofore, electrodes comprising an anti-corrosive conductor such as titanium coated with noble metal have been known. However, they are high in chlorine overvoltage and this disadvantage increases with the lapse of time, when it is used as anode. Furthermore, they are liable to be wetted with sodium amalgam, and similar materials. Additionally they are very expensive and also liable to peeling. Thus, practical utilization of these electrodes has been difficult.

A number of patents have been published concerning electrodes comprising anti-corrosive conductors coated with noble metal oxides. Examples of these include Japanese Patent Publications No. 3409/71, No. 3954/73, No. 29482/71, No. 9402/72, and No. 31510/72. The electrodes disclosed by these patents are coated with noble metal oxides. It has also been proposed in some of these patents to coat a mixture of noble metal oxide with a second component such as titanium oxide, since it is generally difficult to coat a metal such as titanium firmly with a noble metal oxide. Japanese Patent Publication No. 21884/71 discloses an electrode comprising anti-corrosive substrate material coated with a mixed crystal of 50 mol % or more of metal oxide such as titanium oxide or zirconium oxide with a conductor such as a noble metal oxide.

The present invention provides an electrode comprising an anti-corrosive conductor having a coating of a solid solution of a noble metal oxide, titanium oxide and zirconium oxide, the total of titanium oxide and zirconium oxide being from 1 to 50 mol % in said coating.

The present invention also provides a process for producing an electrode as mentioned above, which comprises coating an anti-corrosive conductor with a solution containing a noble metal compound, a titanium compound and a zirconium compound and then heating the coated product to oxidize the coated compounds.

The electrode of the present invention is specific in that the noble metal oxide is not present in the coating in pure form but as a mixed crystal or non-crystalline state. Furthermore, by the use of 1 to 50 mol % of both zirconium oxide and titanium oxide, the electrode is high in oxygen overvoltage in spite of a long life and low chlorine overvoltage. Thus, when the electrode of the invention is provided for use as anode in electrolysis of an aqueous sodium chloride solution, the amount of oxygen gas mixed in the halogen gas such as chlorine can be greatly reduced, the anode potential can be maintained low, and the electrode will have a long and useful life.

The anti-corrosive conductor used in the present invention is a conductor which is anti-corrosive to electrolytes or electrolyzed products which it contacts when used as electrode. These include for example, titanium, zirconium, tantalum, niobium, alloys thereof, carbon, and the like.

Noble metal oxides which may be employed include oxides of ruthenium, rhodium, palladium, osmium, iridium, platinum, and mixtures thereof. Ruthenium oxide is particularly preferred because it is relatively less expensive and low in chlorine overvoltage.

In the solid solution coating according to the present invention, the sum of molar percentages of titanium oxide and zirconium oxide is from 1 to 50 mol %, preferably from 10 to 45 mol %, each of titanium oxide and zirconium oxide can be varied from 0.5 to 49.5 mol %. Within said range, the percentage of titanium oxide is preferably from 10 to 45 mol % and that of zirconium oxide is preferably from 1 to 15 mol %. If the sum is less than 1 mol %, the noble metal oxide cannot be efficiently converted to a solid solution and therefore it is not firmly adhered to the anti-corrosive conductor. As the result, while chlorine overvoltage is low, oxygen overvoltage is also low so that the oxygen gas content of the chlorine gas increases when it is used as anode for electrolysis of sodium chloride. On the other hand, if the amount of sum is more than 50 mol %, the noble metal oxide is so small that chlorine overvoltage rapidly increases and causes an increase of the electrolysis voltage to the practical disadvantage of the process. Additionally, the oxygen gas content in the chlorine gas also increases. Furthermore, when the amount of the noble metal oxide is too small, the electrode is rapidly corroded by the passage of current at high current density.

As mentioned above, the coating of the present invention contains three essential components, namely a noble metal oxide, titanium oxide and zirconium oxide. While being not limited to any theory, the reason for the presence of said essential components will now be explained in detail, as it is currently understood, by referring to the coating wherein ruthenium oxide is used as noble metal oxide.

The binary component system of ruthenium oxide and titanium oxide can be made into a solid solution. The results of X-ray analysis show that there exists a state where neither pure crystal of ruthenium oxide nor pure crystal of titanium oxide is observed. If the coating by this system is in such a state, it will adhere to titanium metal substrates very well. However, when the coated product is used as electrode for electrolysis of sodium chloride, it is low in chlorine overvoltage and the oxygen content of the chlorine gas cannot be decreased. On the other hand, the binary component system consisting of ruthenium oxide and zirconium oxide cannot be made into a solid solution. The results of X-ray analysis establish the presence of pure ruthenium oxide crystal. By the use of an electrode having a coating of this two component system for electrolysis of sodium chloride, the oxygen content in chlorine gas cannot significantly be decreased. Furthermore, such an electrode is unsatisfactory in that the coating adheres poorly to the titanium metal, and that electrode consumption is too high. Whereas, in a ternary component system consisting of ruthenium oxide and 1 to 50 mol % of titanium oxide and zirconium oxide, the components are made completely into a solid solution. The results of X-ray analysis show no trace of pure crystals of ruthenium oxide, titanium oxide nor zirconium oxide. Due to the effect of zirconium oxide added, an electrode coated with a composition of this system reduces oxygen content in chlorine gas to a great extent at the time of electrolysis of sodium chloride. Further, the electrode is endowed with advantages such as low chlorine overvoltage, excellent adhesiveness to titanium substrate, low electrode consumption, and longer electrode life.

The structure of the coating of the invention, whether it is in a state of a solid solution or not, can be determined by precise measurement of the lattice constants according to conventional method using X-ray. The coating of the electrode is mechanically peeled away, and an internal reference substance such as silicon or $\alpha$-alumina is added before it is subjected to X-ray analysis.

According to values in the literature (e.g. ASTM cards), ruthenium oxide belongs to the tetragonal system and has lattice constants of 4.490 A (*a* axis) and 3.106 A (*c* axis); platinum oxide belongs to the rhombic system with *a* axis 4.487 A: *b* axis 4.536 A: *c* axis 3.137 A; iridium oxide belongs to the tetragonal system with *a* axis 4.498 A: *c* axis 3.154 A; rutile type titanium oxide belongs to the tetragonal system with *a* axis 4.594 A: *c* axis 2.958 A; zirconium oxide belongs to the cubic system and has *a* axis of 5.07 A; zirconium oxide belongs to the monoclinic system and has *a* axis of 5.148 A, *b* axis of 5.203 A, *c* axis of 5.316 A and $\beta$=99°23′.

Within the precision of the available measurement technique, variations of lattice constants of 0.01 A or more can clearly be confirmed. The term "solid solution" as used in the present disclosure refers to a product which deviates 0.01 A or more from the lattice constant of a pure noble metal oxide crystal. Accordingly, the solid solution includes mixed crystals and amorphous state structures.

There are various processes for producing a coating of a solid solution. For example, a substrate is directly coated with a molten mixture. Alternatively, salts dissolved in an aqueous solution or an organic solvent are pyrolyzed and precipitated on a substrate. Among them, it is preferred from a practical standpoint to coat an anti-corrosive conductor with an aqueous hydrochloric acid solution of a noble metal chloride, titanium chloride and zirconium chloride and heat the coated product at a temperature higher than the thermal decomposition temperatures of said chlorides. A practical temperature is from 300° to 700° C, preferably from 400° to 600° C, in an oxidative atmosphere in the presence of sufficient oxygen to oxidize the decomposed metal compounds. Air is typically employed. The time of the heating is at least one minute.

Furthermore, for acceleration of formation of a solid solution, other substances such as silica, alumina, boron oxide, lead oxide can also be added to the coating composition, whereby adhesiveness of the coating to the anti-corrosive conductor can be improved. In order to effect formation of a solid solution more easily, it is preferred to increase the number of coats by adjusting the concentration or viscosity of the coating composition so that the thickness per coat may be as thin as possible, for example, 3 microns or less, desirably 0.5 micron or less. The thickness of the coating is not limited, but it is usually from 1 to 20 microns. If a thick coating is desired, said coating and heating procedures may be performed a number of times.

It is very surprising that a solid solution is formed, as determined by X-ray analysis, even though the coating is treated at a temperature, e.g. 600° C or lower, which is lower than the melting points of titanium oxide, zirconium oxide or of the noble metal oxide. In the state of such a solid solution, the ratio of metal atoms of each component to oxygen atoms can no longer be expressed as a ratio of whole numbers. Thus, the solid solution is distinguished from the conventional metal oxides.

The thus prepared electrode which is coated with the solid solution as described above is improved not only in mechanical adhesiveness to substrate but also in resistance to chemical corrosion. Therefore, when it is used as an anode, it can be employed for a long time with low electrode consumption. Furthermore, the solid solution of the invention exhibits very good electric conductivity and shows a very low electrode potential at a current density as high as 100 ampere/dm$^2$ or more. Even after electrolysis operation continued for a year or more no increase in voltage is observed.

The electrode of the invention can be used as anode for electrolysis of an aqueous halide solutions. In particular, it can suitably be used as anode for production of caustic soda or caustic potash by either the diaphragm or ion-exchange membrane process, as well as for production of chlorate and bromine gas.

The following non-limiting examples are given by way of illustration only.

Example 1

A mesh with opening ratio of 60% prepared from a plate of titanium metal with thickness of 1.5 mm is polished with a polishing powder and then dipped in 20 wt. % aqueous sulfuric acid solution at 80° C for 2 hours to coarsen the surface. On this substrate is coated a solution of 0.33 mol/l ruthenium trichloride, 0.13 mol/l of zirconium chloride and 0.13 mol/l titanium tetrachloride dissolved in 20 wt. % aqueous hydrochloric solution, followed by heating at 450° C in the air for 5 minutes. This coating operation is repeated 10 times, followed finally by calcination at 500° C in the air for 3 hours, to produce an electrode. The thickness of coating applied is on the average about 0.2 microns per cycle.

This coating is mechanically rubbed off and the powders of the coating are subjected to analysis by fluorescent X-ray to determine that the composition consists of 0.68:0.13:0.19 in terms of the molar ratio of ruthenium oxide:titanium oxide:zirconium oxide. The coating is substantially free from chlorine, i.e. less than 0.1 wt. %.

Then, the powders of the coating are mixed with metallic silicon as the primary reference and also with $\alpha$-alumina in case when there are overlapping peaks as secondary reference to permit measurement of lattice constants of the crystal by means of X-ray analysis apparatus using $K_\alpha$ line of copper (wavelength: 1.54050 A). As the result, only peaks of a tetragonal system with a axis of 4.562 A and *c* axis of 3.090 A are detected. As clearly seen from this result, a solid solution is formed by deviating from the crystal lattice constants of pure ruthenium oxide and titanium oxide, indicating that neither pure ruthenium oxide nor pure titanium oxide is present. The absence of peaks corresponding to the rhombic system and cubic system of zirconium oxide proves that zirconium oxide is also converted into a solid solution.

In an electrolytic cell, wherein an electrode of 1.2 m square prepared according to the above procedure is used as anode, a mesh electrode made of iron is used as cathode and a cation exchange membrane is used as diaphragm, an anolyte comprising an aqueous sodium chloride solution, which is maintained at pH of 3.5 and at a concentration of 2.5 N, is circulated. As catholyte, 5 N aqueous caustic soda solution is circulated. Both electrolytes are maintained at 90° C and electrolysis is performed at current density of 50 ampere/dm², while generating chlorine gas from anode and hydrogen gas from cathode. Under these conditions, continuous running is carried out for 200 days, and no electrode consumption change in voltage is observed. The content of oxygen gas in the chlorine gas is found to be 0.86% by volume, which is by far lower than the oxygen content of the chlorine gas in the following reference example 1.

REFERENCE EXAMPLE 1

For comparative purpose, experiments are conducted by using an electrode having only ruthenium oxide coated thereon, an electrode having only ruthenium oxide and zirconium oxide coated thereon and an electrode having only ruthenium oxide and titanium oxide coated thereon.

Each electrode is prepared by repeating the procedure, comprising coating on the same anti-corrosive substrate as used in Example 1 a solution of chlorides having the composition as shown in Table 1 dissolved in 20 wt. % of a hydrochloric acid solution and heating the coated product at 450° C in the air for 5 minutes, for 10 times, followed finally by calcination at 500° C in the air for 3 hours. The average thickness of the coating per cycle is about 0.2 microns.

The composition of each coating as well as crystal lattice constants thereof are determined in the same manner as in Example 1. Furthermore, by using each electrode as anode, the same electrolysis as described in Example 1 is repeated, whereby oxygen gas content in chlorine gas is measured. These results are set forth in Table 1.

Table 1

| Experiment No. | Coating composition (mol/l) Ru | Zr | Ti | Coated products (mol %) $RuO_2$ | $ZrO_2$ | $TiO_2$ | Lattice constants in tetragonal system of the coated products (A) a axis | c axis | Other crystal | Chlorine overvoltage (V/S.C.E.) 50A/dm² | Oxygen content in chlorine gas (vol. %) |
|---|---|---|---|---|---|---|---|---|---|---|---|
| 1 | 0.6 | 0 | 0 | 100 | — | — | 4.493 | 3.103 | none | 1.10 | 2.10 |
| 2 | 0.2 | 0.4 | 0 | 42 | 58 | — | 4.499 | 3.106 | $ZrO_2$ cubic and monoclinic | 1.25 | 1.53 |
| 3 | 0.4 | 0.2 | 0 | 74 | 26 | — | 4.490 | 3.110 | none | 1.16 | 1.45 |
| 4 | 0.2 | 0 | 0.4 | 50 | — | 50 | 4.563 | 3.001 | none | 1.27 | 1.30 |
| 5 | 0.4 | 0 | 0.2 | 80 | — | 20 | 4.579 | 3.051 | none | 1.16 | 1.42 |

Table 1 clearly shows that the lattice constants of the coating consisting of ruthenium oxide only are approximately the same as the published values indicating that substantially no solid solution is formed (see experiment No. 1). The powders of the coating consisting of ruthenium oxide and zirconium oxide include tetragonal system, cubic system and monoclinical system crystals. Among them, the lattice constants of the tetragonal system are approximately the same as those of the pure ruthenium oxide, indicating that the ruthenium oxide remains unchanged. It is also confirmed that there exists a mixture of zirconium oxides of which the tetragonal system crystal has *a* axis of 5.116 A and of which the monoclinical system crystal has *a* axis of 5.187 A, *b* axis of 5.116 A and *c* axis of 5.527 A with $\beta$=100°~' (see experiment No. 2 and No. 3). The powders of the coating consisting only of ruthenium oxide and titanium oxide show crystals only of the tetragonal system, but the lattice constants thereof deviate greatly from those of either pure ruthenium oxide or titanium oxide to indicate that they are converted into a solid solution. However, when the electrode having this coating is used as anode, oxygen content in chlorine gas cannot be lowered sufficiently.

When these results are compared with those of Example 1, the amount of oxygen generated is shown to be less in the electrode of the ternary component system of ruthenium oxide, zirconium oxide and titanium oxide than in any of the electrodes of ruthenium oxide only, ruthenium oxide and zirconium oxide, and ruthenium oxide and titanium oxide.

EXAMPLE 2

The compositions of the coatings of ruthenium oxide, zirconium oxide and titanium oxide are varied in this Example. Substrates of the same titanium metal mesh as used in Example 1 are coated with solutions of chlorides having the compositions as shown in Table 2 dissolved in 20 wt. % aqueous hydrochloric acid, respectively, followed by heating at 490° C in the air for 5 minutes. This coating procedure is repeated ten times for each sample, followed finally by calcination at 500° C in the air for 3 hours. The thickness per coat is about 0.2 microns on the average. The results of analysis of each coating and electrolysis by using each electrode which are performed under the same conditions as in Example 1 are set forth in Table 2.

As seen from Experiments No. 2 to 6, the amount of oxygen gas in the chlorine is smaller with electrodes coated with a solid solution of ruthenium oxide with 1 to 50 mol % of zirconium oxide and titanium oxide than with those coated with a solid solution outside said range.

The chlorine overvoltages in the Tables are shown in terms of values relative to the saturated calomel electrode (S.C.E.) when electrolysis is performed in an aqueous sodium chloride solution at the current density of 50 ampere/dm². Experiments No. 1 to 6 clearly show that chlorine overvoltage is too high with electrodes having less than 50% of ruthenium oxide content in the coating to practical disadvantage, while it is approximately constant, i.e. 1.10 V, with the electrode having 50% or more of ruthenium oxide content in the coating.

Corrosion resistance tests of these electrodes is conducted using approximately the same electrolytic cell as in Example 1 and 5 N aqueous sodium chloride solution as the anolyte and performing electrolysis at 300 ampere/dm². The amount of consumption is measured, and the percentage by weight of the consumption relative to the amount of coating is calculated. The results are shown in the column of consumption degree, which clearly shows that with the electrodes of the present invention, (Experiments Nos. 2 to 6) are there is less electrode consumption amount than with electrodes wherein only ruthenium oxide is coated and with electrodes wherein the ruthenium oxide is less than 50 mol %.

Table 2

| Experiment No. | Coating composition (mol/l) Ru | Zr | Ti | Coated product (mol %) $RuO_2$ | $ZrO_2$ | $TiO_2$ | Lattice constants of tetragonal system crystals in coated product (A) a axis | c axis | Chlorine overvoltage (V/S.C.E.) 50 A/dm² | Oxygen content in chlorine gas (vol.%) pH:3.5 | Electrode consumption (300 A/dm²) 18 hours) (%) |
|---|---|---|---|---|---|---|---|---|---|---|---|
| 1 | 1 | 0 | 0 | 100 | 0 | 0 | 4.493 | 3.103 | 1.10 | 2.06 | 15.0 |
| 2 | 0.98 | 0.01 | 0.01 | 98.8 | 0.7 | 0.5 | 4.519 | 3.104 | 1.10 | 1.06 | 4.4 |
| 3 | 0.80 | 0.10 | 0.10 | 87 | 7.6 | 5.4 | 4.542 | 3.100 | 1.10 | 0.90 | 5.0 |
| 4 | 0.72 | 0.14 | 0.14 | 81 | 11 | 8 | 4.555 | 3.077 | 1.10 | 0.80 | 5.5 |
| 5 | 0.59 | 0.18 | 0.24 | 71 | 15 | 14 | 4.559 | 3.092 | 1.10 | 0.85 | 6.5 |
| 6 | 0.50 | 0.20 | 0.30 | 63 | 18 | 19 | 4.572 | 3.088 | 1.11 | 0.87 | 9.5 |
| 7 | 0.30 | 0.30 | 0.40 | 42 | 30 | 28 | 4.499 | 3.110 | 1.14 | 1.52 | 25 |
| 8 | 0.20 | 0.40 | 0.40 | 29 | 41 | 30 | 4.500 | 3.106 | 1.18 | 1.35 | 80 |

Furthermore, as seen from Experiment No. 2, by addition of only about 1% of titanium oxide and zirconium oxide, the *a* axis lattice constant of the tetragonal system is significantly changed to indicate formation of a solid solution.

The results in Tables 1 and 2 show that the electrodes of the present invention coated wih a solid solution comprising 1 to 50 mol % of the sum of titanium oxide and zirconium oxide and ruthenium oxide are excellent with any respect, i.e. low oxygen content in chlorine gas at the time of electrolysis, low electrode consumption and low chlorine overvoltage.

EXAMPLE 3

A mesh with opening ratio of 60% prepared from a plate of titanium metal with thickness of 1.5 mm is subjected to the same treatment as in Example 1 and used as the anti-corrosive conductor. As the noble metals, ruthenium-platinum and ruthenium-rhodium are used. The chlorides of respective metals are dissolved in 20 wt. % hydrochloric acid solution to prepare coating liquids. Each coating liquid is coated, and then heated at 500° C in the air for 5 minutes. The procedures are repeated 10 times, followed finally by calcination at 550° C in the air for 3 hours, to produce an electrode. The thickness of coating applied per cycle is about 0.15 microns.

These electrodes are subjected to measurement of electrode compositions and lattice constants to give the results as set forth in Table 3, which shows that the electrodes have excellent characteristics with coatings converted into solid solutions.

EXAMPLE 4

Zirconium metal plate is used as the anti-corrosive conductor. After the plate is defatted by polishing powders, the surface thereof is coarsened with water resistant number 240 paper. A solution of 0.1 mol of titanium tetrachloride, 0.1 mol of zirconium tetrachloride, 0.5 mol of iridium chloride, 100 ml. of 35 wt. % conc. hydrochloric acid and 900 ml. of ethyl alcohol is coated on the plate, followed by heating at 500° C in the air for 10 minutes. This procedure is repeated 20 times before the electrode is produced.

When the coating thus produced is analyzed by the procedure similar to Example 1, the molar % of iridium oxide, titanium oxide and zirconium oxide in the powders of the coating is found to be 81%, 8% and 11%, respectively. The tetragonal crystal system has *a* axis of 4.541 A and *c* axis of 3.096 A to indicate that the three components form a solid solution.

Electrolysis of saturated aqueous potassium chloride solution is conducted by using this electrode as anode and mercury as cathode under the conditions of current passage area of 5 cm × 5 cm, current density of 30 ampere/dm², electrolyte temperature at 70° C and at pH 2. As a result, the oxygen gas content in the chlorine gas is found to be less than 0.1%.

EXAMPLE 5

Tantalum is used as the anti-corrosive conductor. After it is subjected to the same treatment as in Example 4, a solution of 0.72 mol of rhodium chloride, 0.14 mol of titanium hydroxide and 0.14 mol of zirconium hydroxide dissolved in 35 wt. % conc. hydrochloric acid is coated thereon. It is then heated at 450° C in the air for 5 minutes. This procedure is repeated 10 times, followed finally by calcination for 3 hours in air to produce an electrode.

When the powders of the coating are subjected to X-ray analysis, it is found that they are all in amorphous state with no crystal formation.

Table 3

| Experiment No. | Composition of coated product (mol %) $RuO_2$ | $PtO_2$ | $PdO_2$ | $Rh_2O_3$ | $TiO_2$ | $ZrO_2$ | Lattice constants of tetragonal system crystals in coated product (A) a axis | c axis | Other crystal | Chlorine overvoltage (V/S.C.E.) 50 A/dm² | Oxygen content in chlorine gas (vol. %) pH:3.5 | Electrode consumption (300 A/dm², 18 hours) (%) |
|---|---|---|---|---|---|---|---|---|---|---|---|---|
| 1 | 60 | 10 | — | — | 20 | 10 | 4.574 | 3.083 | none | 1.12 | 0.86 | 6.0 |
| 2 | 60 | — | 5 | — | 25 | 10 | 4.529 | 3.101 | none | 1.10 | 0.90 | 10.5 |
| 3 | 60 | — | — | 10 | 20 | 10 | 4.560 | 3.093 | none | 1.11 | 0.91 | 8.0 |

Electrolysis is conducted by using this electrode as anode, an iron mesh electrode as cathode and a cation exchange membrane as diaphragm at 30 ampere/dm$^2$, utilizing 2 N lithium chloride solution as anolyte at pH 3.5 to produce 3 N lithium hydroxide as catholyte. The oxygen content in chlorine gas generated from the anode is 1.0 vol. %.

EXAMPLE 6

Titanium is used as the anti-corrosive conductor. It is subjected to surface treatment by dipping in an aqueous oxalic acid solution at 90° C for 4 hours. Then, on this substrate is coated a solution of 0.7 mol/l ruthenium chloride, 0.1 mol/l zirconium chloride and 0.2 mol/l titanium chloride, followed by heating at 500° C for 10 minutes. This procedure is repeated 20 times before the electrode is produced.

Electrolysis is conducted using this electrode as anode, asbestos as diaphragm and a mesh electrode of iron as cathode at a current density of 20 ampere/dm$^2$. A saturated sodium chloride solution of pH 4.5 is used as anolyte and an aqueous solution comprising caustic soda and sodium chloride as catholyte. The oxygen gas content in the chlorine gas obtained is 2.0%. When electrolysis is performed by using an electrode which is coated with ruthenium oxide only, the oxygen content in chlorine gas is 4.0%.

EXAMPLE 7

On a titanium alloy rod 3 mm in diameter is coated a 25 wt. % aqueous hydrochloric acid solution containing 0.1 mol ruthenium chloride, 0.05 mol titanium bromide, 0.025 mol zirconium chloride, 0.01 mol silicon chloride and 0.01 mol sodium borate, followed by heating at 450° C. After repeating said procedure, an electrode is produced.

The coating of this electrode is subjected to X-ray analysis to determine that a solid solution of oxides of ruthenium, zirconium, silicon and boron is formed and that no pure ruthenium oxide is present in the coating.

EXAMPLE 8

An electrode is produced by dipping a carbon plate 10 mm thick in a molten salt consisting of silica, lead oxide and borax containing 0.1 mol ruthenium oxide, 0.01 mol iridium oxide, 0.03 mol titanium oxide and 0.01 mol zirconium oxide. When the coating is analyzed by X-ray, it is found that a solid solution is formed and no pure ruthenium oxide nor iridium oxide is present.

REFERENCE EXAMPLE 2

Comparative tests are carried out using various electrodes coated with three components consisting of ruthenium oxide, titanium oxide and either tantalum oxide, niobium oxide, bismuth oxide or tungsten oxide.

As the anti-corrosive conductor, the same mesh with opening ratio of 60% prepared from a titanium plate 1.5 mm thick as used in Example 1 is used in each sample. The chlorides with compositions as shown in Table 4 are dissolved in 25 wt. % of hydrochloric acid solutions to prepare the coating compositions. Each electrode is produced by repeating the procedure, which comprises coating each composition and then heating the coated product at 450° C in air for 5 minutes, for 10 times, followed finally by calcination at 500° C in air for 3 hours.

Electrolysis experiments are carried out using these electrodes and the same electrolytic cell under the same electrolysis conditions as in Example 1. The oxygen contents of chlorine gas are measured to give the results shown in Table 4.

Table 4 clearly shows that oxygen concentration in chlorine gas is not decreased by utilization of the electrodes of the above comparative experiments.

EXAMPLE 9

Example 1 is repeated, but ruthenium oxide is replaced by a mixture of ruthenium oxide and platinum oxide, a mixture of ruthenium oxide and palladium oxide, a mixture of ruthenium oxide and rhodium oxide or a mixture of ruthenium oxide and iridium oxide, the ratio of ruthenium oxide to other metal oxide in each mixture being 50:50 (by weight). In each case, the result obtained is similar to that in Example 1.

Table 4

| Experiment No. | Coating composition (mol %) | | | | | | Composition of coated product (mol %) | | | | | | Oxygen content in chlorine gas (vol. %) |
|---|---|---|---|---|---|---|---|---|---|---|---|---|---|
| | Ru | Ti | Ta | Nb | Bi | W | $RuO_2$ | $TiO_2$ | $TaO_2$ | $NbO_2$ | $Bi_2O_3$ | $WO_3$ | |
| 1 | 83.6 | 13.5 | 2.9 | 0 | 0 | 0 | 90.2 | 7.3 | 2.5 | 0 | 0 | 0 | 1.62 |
| 2 | 49.0 | 39.0 | 12.0 | 0 | 0 | 0 | 63.0 | 25.2 | 11.8 | 0 | 0 | 0 | 1.74 |
| 3 | 92.8 | 4.9 | 0 | 2.3 | 0 | 0 | 95.6 | 2.5 | 0 | 1.9 | 0 | 0 | 1.70 |
| 4 | 46.0 | 34.0 | 0 | 20.0 | 0 | 0 | 58.2 | 21.7 | 0 | 21.0 | 0 | 0 | 1.58 |
| 5 | 54.5 | 36.4 | 0 | 0 | 9.1 | 0 | 66.8 | 22.3 | 0 | 0 | 10.9 | 0 | 1.77 |
| 6 | 54.5 | 36.4 | 0 | 0 | 0 | 9.1 | 67.3 | 22.4 | 0 | 0 | 0 | 10.3 | 1.72 |

What we claim is:

1. An electrode comprising an anti-corrosive conductor having a coating of a solid solution containing at least one noble metal oxide together with titanium oxide and zirconium oxide, the total amount of titanium oxide plus zirconium oxide being from 1 to 50 %; said total amount containing from 0.5 to 49.5 mol % titanium dioxide and 0.5 to 49.5 mol % zirconium oxide.

2. An electrode as claimed in claim 1, wherein the noble metal oxide is ruthenium oxide.

3. An electrode as claimed in claim 1, wherein the noble metal oxide is a mixture of ruthenium oxide and platinum oxide.

4. An electrode as claimed in claim 1, wherein the noble metal oxide is a mixture of ruthenium oxide and palladium oxide.

5. An electrode as claimed in claim 1, wherein the noble metal oxide is a mixture of ruthenium oxide and rhodium oxide.

6. An electrode as claimed in claim 1, wherein the noble metal oxide is a mixture of ruthenium oxide and iridium oxide.

7. An electrode as in claim 1 wherein the total amount of titanium oxide plus zirconium oxide contains from 10 to 45 mol % titanium oxide and 1 to 15 mol % zirconium oxide.

8. An electrode as claimed in claim 7 wherein the noble metal oxide is ruthenium oxide.

9. An electrode as claimed in claim 7 wherein the noble metal oxide is a mixture of ruthenium oxide and platinum oxide.

10. An electrode as claimed in claim 7 wherein the noble metal oxide is a mixture of ruthenium oxide and palladium oxide.

11. An electrode as claimed in claim 7 wherein the noble metal oxide is a mixture of ruthenium oxide and rhodium oxide.

12. An electrode as claimed in claim 7 wherein the noble metal oxide is a mixture of ruthenium oxide and iridium oxide.

13. A process for producing an electrode comprising an anti-corrosive conductor having a coating of a solid solution containing at least one noble metal oxide together with titanium oxide and zirconium oxide, the total amount of titanium oxide plus zirconium oxide being from 1 to 50 mol %; said total amount containing from 0.5 to 49.5 mol % titanium dioxide and 0.5 to 49.5 mol % zirconium oxide; which process comprises coating said anti-corrosive conductor by precipitating a mixture containing a sufficient amount of a noble metal compound, a titanium compound, and a zirconium compound from a solution containing said compounds to produce the said solid solution when said precipitate is heated at a temperature of from 300° to 700° C in the presence of oxygen, and thereafter heating said precipitate at a temperature of from 300° to 700° C in the presence of sufficient oxygen to oxidize the said compounds.

14. A process as claimed in claim 13 wherein heating is effected at a temperature of from 400° to 600° C.

15. A process as claimed in claim 13, wherein the coating and the heating are repeated in plural cycles.

16. A process as claimed in claim 15, wherein the thickness of coating per each cycle is controlled to 0.5 micron or less.

* * * * *